US007537494B1

(12) United States Patent
Umlauf

(10) Patent No.: US 7,537,494 B1
(45) Date of Patent: May 26, 2009

(54) ELECTRICAL CONNECTOR WITH CANTILEVER ARM

(75) Inventor: Thomas E. Umlauf, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/102,511

(22) Filed: Apr. 14, 2008

(51) Int. Cl.
*H01R 11/09* (2006.01)

(52) U.S. Cl. ..... 439/798; 439/814

(58) Field of Classification Search ..... 439/798, 439/797, 810–814, 727, 771, 762, 765
See application file for complete search history.

(56) References Cited

U.S. PATENT DOCUMENTS

| | | | | |
|---|---|---|---|---|
| 3,585,571 | A | 6/1971 | Davis et al. | |
| 3,605,067 | A | 9/1971 | Szabo et al. | |
| 3,688,247 | A | 8/1972 | Prodel | |
| 4,293,176 | A | 10/1981 | Lindlöf | |
| 4,327,957 | A | 5/1982 | Cooper, Jr. et al. | |
| 4,550,965 | A | 11/1985 | Izraeli | |
| 4,684,196 | A | 8/1987 | Smith et al. | |
| 4,723,920 | A * | 2/1988 | Werner | 439/782 |
| 4,740,179 | A * | 4/1988 | Padget | 439/765 |
| 4,857,020 | A * | 8/1989 | Crosby | 439/783 |
| 4,915,653 | A * | 4/1990 | Mair | 439/781 |
| 5,041,012 | A | 8/1991 | Caprio | |
| 5,580,284 | A * | 12/1996 | Laricchia | 439/783 |
| 6,203,384 | B1 * | 3/2001 | DeFrance | 439/798 |
| 6,263,567 | B1 | 7/2001 | McGrane | |
| 6,338,658 | B1 * | 1/2002 | Sweeney | 439/810 |
| 6,664,469 | B1 * | 12/2003 | Sweeney | 174/51 |
| 6,676,454 | B2 * | 1/2004 | De France | 439/806 |
| 6,769,941 | B2 | 8/2004 | Norden | |
| 6,939,183 | B2 * | 9/2005 | Ferretti et al. | 439/798 |
| 7,044,776 | B2 * | 5/2006 | King et al. | 439/521 |
| 7,048,591 | B1 * | 5/2006 | Chiang | 439/709 |
| 7,056,151 | B2 | 6/2006 | Cawood et al. | |
| 7,090,544 | B2 | 8/2006 | Campbell et al. | |
| 7,104,832 | B2 | 9/2006 | Campbell et al. | |
| 7,128,619 | B1 | 10/2006 | Muench, Jr. | |
| D536,307 | S | 2/2007 | Rizzo et al. | |
| 7,175,454 | B2 | 2/2007 | Araki et al. | |
| 7,438,607 | B2 * | 10/2008 | Fong | 439/810 |
| 2003/0124915 | A1 * | 7/2003 | Kaine et al. | 439/798 |
| 2004/0067697 | A1 * | 4/2004 | Zahnen | 439/798 |
| 2006/0183382 | A1 * | 8/2006 | King et al. | 439/798 |

OTHER PUBLICATIONS

Advertisement: "The Brains of the Operation," Ilsco advertisement, *TED* magazine, Nov. 2007, 2 pages.

* cited by examiner

*Primary Examiner*—Neil Abrams
*Assistant Examiner*—Harshad C Patel
(74) *Attorney, Agent, or Firm*—Melanie Gover

(57) ABSTRACT

An electrical connector configured to maintain an electrical connection with a conductor during heating and cooling cycles is provided. The electrical connector includes a base portion and an arm extending from the base portion. The arm and the base portion combine to define an opening configured to receive the conductor, and one of the arm and the base portion defines a bore communicating with the opening. A fastener inserted into the bore is configured to retain the conductor inserted into the opening, and the arm is configured to deflect to provide a spring force that secures the fastener against the conductor during the heating and cooling cycles.

13 Claims, 4 Drawing Sheets

ELECTRICAL CONNECTOR WITH CANTILEVER ARM

BACKGROUND

Electrical power cables are common and employed for distributing power across power grids or networks, such as when moving electricity from power generation plants to electric power consumers. Power cables are conductors and generally include a conductive core (typically copper or aluminum) optionally surrounded by one or more layers of insulating material. The conductive core includes solid cores or a plurality of twisted conductive strands constructed to carry high voltages (greater than about 50,000 Volts), medium voltages (between about 1,000-50,000 Volts), or low voltages (less than about 1,000 Volts).

Occasionally one desires to form a splice or a junction in the power cable to distribute electricity to additional branches of the grid or network. Splices are commonly employed to deliver electricity to individual homes, businesses, and/or offices. For example, a "feeder line" supplying electrical power to a group of several buildings may be spliced or branched into one or more "service lines," each of which may be connected to one of the group of buildings being serviced. As used herein, the terms "splice" and "junction" are used interchangeably, and in each case refers to the portion of a power distribution system where an incoming cable connects to at least one outgoing cable.

Splices and junctions typically employ one or more electrical conductors. After the splice is formed and power is restored, current flowing through the feeder and service lines will heat the connector. During periods of low electrical demand, current flowing through the feeder and service lines ceases or abates, and the connector cools. Such cyclic heating and cooling can expand and contract the connector, potentially undesirably loosening the electrical connection between the connector and the feeder or service lines. Loose connector lines can reduce the electrical performance of the junction.

In addition, field operators recognize that a large number of connectors should be kept in the field inventory to accommodate as many different splice configurations as possible. A typical connector inventory, for example, can include at least five different configurations, each configuration having a different number of connection ports (i.e., one port, two ports, or six or more ports). The large number of connector variations maintained in inventory, however, yields higher inventory costs for the end user. A large connector inventory, moreover, potentially reduces productivity for the end user who must expend time selecting and locating an appropriate connector for a given individual installation.

Existing power grids and networks also change as new homes and businesses are constructed and as existing homes and businesses are renovated. The industry therefore desires connectors that maintain high-performance electrical connections, allow for easy expansion of the power distribution system and readily adapt to changing service configurations.

SUMMARY

One aspect of the invention provides an electrical connector configured to maintain an electrical connection with a conductor during heating and cooling cycles. The electrical connector includes a base portion and an arm extending from the base portion. The arm and the base portion combine to define an opening configured to receive the conductor, and one of the arm and the base portion defines a bore communicating with the opening. A fastener inserted into the bore is configured to retain the conductor inserted into the opening, and the arm is configured to deflect and provide a spring force that secures the fastener against the conductor during heating and cooling cycles.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to one another. Like reference numerals designate correspondingly similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It will also be understood that features of the various exemplary embodiments described herein may be combined with each other, unless specifically noted otherwise.

Embodiments of the invention provide an electrical connector configured to maintain an electrical connection with a conductor during heating and cooling cycles. In one embodiment, the electrical connector includes a compliant arm configured to deflect and provide a compressive spring force to a fastener in contact with the conductor. Other embodiments provide a series of connectors, each including a compliant arm configured to maintain a compressive spring force between a fastener in contact with a conductor.

Embodiments of the invention provide a bus bar electrical connector including a plurality of openings and a compliant arm disposed between adjacent openings. Other embodiments provide a bus bar connector assembly that includes a feeder line inserted into an opening and one or more service lines exiting from one or more branch openings. The connector assembly serves as a junction for splicing an incoming feeder line to one or more outgoing service lines that branch across a grid to, for example, a neighborhood of homes or several businesses.

Figure 1:
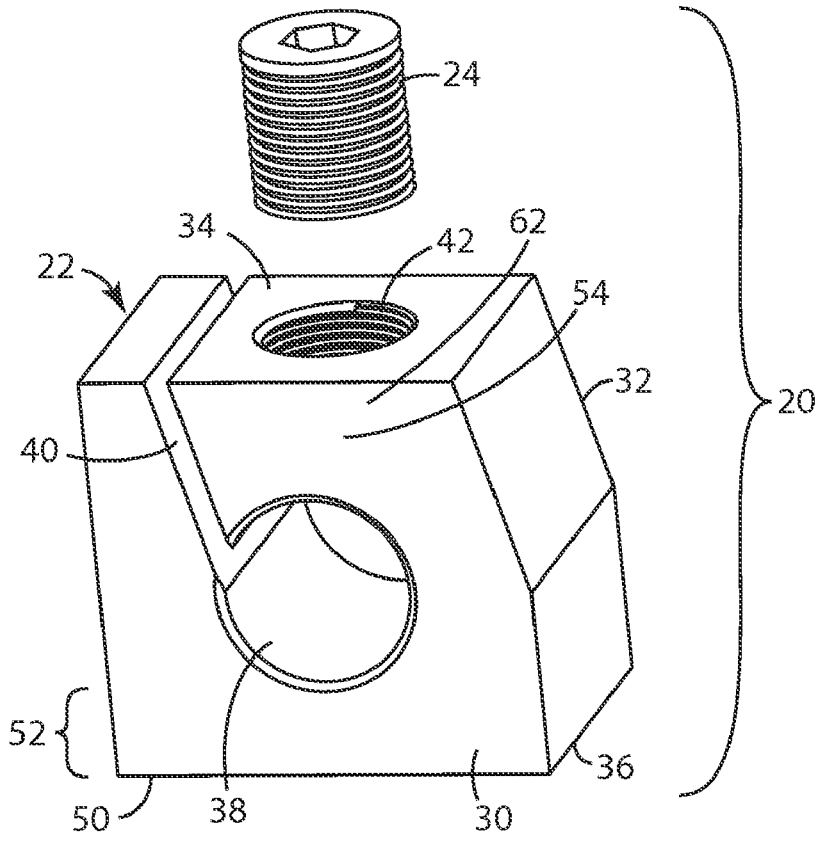
FIG. 1 is a perspective view of an electrical connector according to one embodiment of the invention.

FIG. 1 presents a perspective view of an electrical connector 20 according to one embodiment. Electrical connector 20 includes a body 22 configured to receive a conductor and a fastener 24 that may be inserted into body 22 to compliantly retain the conductor.

In one embodiment, body 22 includes a first major face 30 opposite a second major face 32, opposing first and second side surfaces 34, 36 extending between opposing major surfaces 30, 32, an opening 38 defined by body 22 extending between major surfaces 30, 32, a slot 40 extending between opening 38 and first side surface 34, and a bore 42 formed in first side surface 34 and communicating with opening 38. When a conductor is inserted into opening 38 and fastener 24 is secured against the conductor, a portion of body 22 is configured to store energy and compliantly force fastener 24 against the conductor such that electrical connection is maintained between body 22 and the conductor during cyclical heating and cooling of connector 20.

In one embodiment, body 22 includes a base 50, a base portion 52 adjacent to base 50, and an arm 54 extending from base portion 52. Base portion 52 and arm 54 combine to define opening 38, such that arm 54 is defined at least in part by opening 38, slot 40, and first side surface 34. In one embodiment, arm 54 is cantilevered from base portion 52 such that a head 62 of arm 54 formed by surface 34 and slot 40 is decoupled from and enabled to move relative to base portion 52. The cantilevered arm 54 is configured to move and/or flex to accommodate the expansion or contraction of body 22 as connector 20 cyclically heats and cools.

In this specification, the term "cantilevered" refers to a structure extending from and supported by a base or base portion and including a load supporting member or head that is substantially opposite the base or base portion.

In one embodiment, bore 42 is formed in arm 54 and extends between first side surface 34 and opening 38. Bore 42 is sized to receive fastener 24, and in one embodiment includes a threaded bore sized to receive threaded set screw-styled fastener 24. Other locations for bore 42 and other fastening mechanisms are also contemplated and considered acceptable.

Electrical connector 20 is configured to provide and maintain an electrical connection with a conductor inserted into opening 38. Suitable materials for body 22 of electrical connector 20 generally include electrically conductive metals that will deflect under the force of fastener 24 to provide a return spring force. One suitable material for fabrication of body 22 is aluminum, although other metals such as copper, alloys of copper, alloys of aluminum, or bronze are also acceptable.

Fastener 24 includes any suitable fastener configured to interlock with body 22 and provide sufficient compression against a conductor inserted into opening 38 in a manner that will deflect arm 54. One suitable fastener 24 includes a hex-head socket threaded fastener, although other suitable fasteners such as bolts and the like are also acceptable. In one embodiment, fastener 24 is selected to have similar electrical properties and a similar coefficient of thermal expansion as body 22. One suitable material for fastener 24 is aluminum, although other metals such as bronze, stainless steel and copper are also suitable.

In another embodiment of the invention, body 22 is fabricated from a first conductive metal and fastener 24 is fabricated from a second separate conductive metal. In one embodiment, for example, electrical connector 20 is configured for use in an enclosed transformer box. Body 22 is fabricated of aluminum and fastener 24 is fabricated of stainless steel. In other embodiments, body 22 may be fabricated of bronze when electrical connector 20 is employed in or exposed to oxidative or corrosive environments.

Figure 2A:
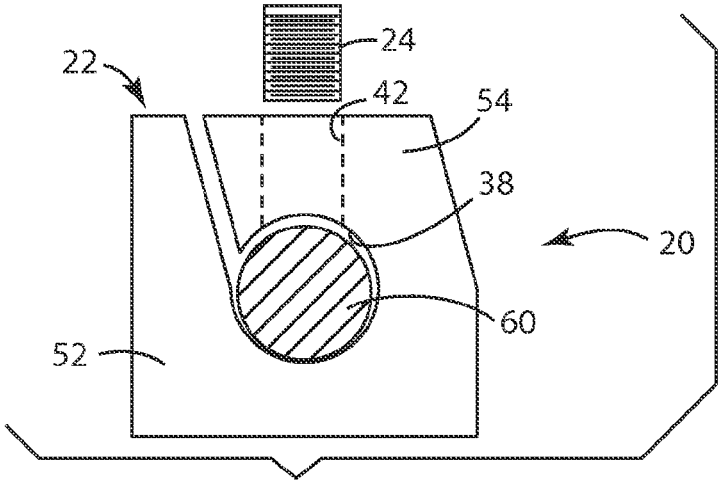
FIG. 2A is a front view of a conductor inserted into an opening of an electrical connector according to one embodiment of the invention.
Figure 2B:
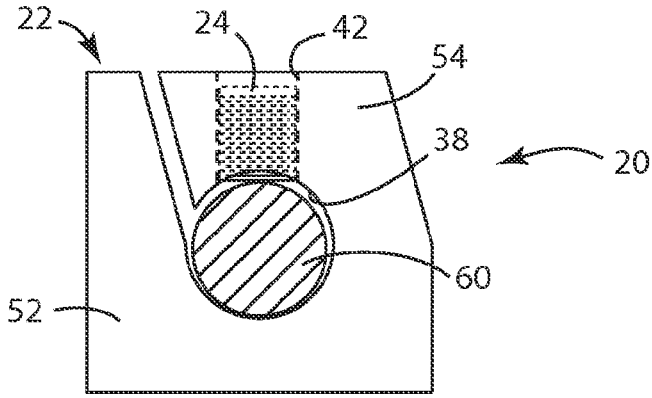
FIG. 2B is a front view of an electrical connector as shown in FIG. 2A including a fastener in contact with the conductor.
Figure 2C:
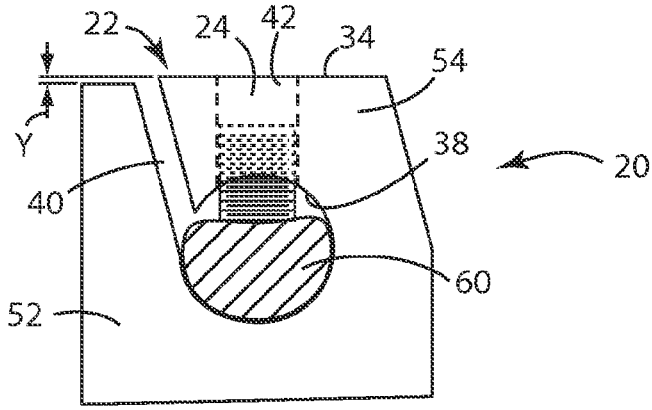
FIG. 2C is a front view of an electrical connector as shown in FIG. 2B including the fastener secured against the conductor and an arm of the electrical connector deflected to provide a spring force that retains the fastener against the conductor.

FIGS. 2A-2C present front views of electrical connector 20 employed to form an electrical splice or junction with conductor 60. Conductor 60 is shown in cross-section for ease of illustration; other conformations of conductor 60 are also acceptable.

FIG. 2A presents a front view of conductor 60 inserted into opening 38 of electrical connector 20. Insulation, if provided on conductor 60, can be removed to enable electrical connection between conductor 60 and body 22. Conductor 60 includes solid metal conductors, conductor strands, braided strands of conductors, and the like. Fastener 24 is shown removed from bore 42, although fastener 24 could be threaded partway into bore 42 provided adequate clearance is provided to allow for insertion of conductor 60.

FIG. 2B presents a front view of electrical connector 20 with fastener 24 in contact with inserted conductor 60. Fastener 24 projects through bore 42 into opening 38 and engages with an exterior surface of conductor 60.

FIG. 2C presents a front view of electrical connector 20 configured to maintain electrical connection with conductor 60 during heating and cooling cycles. Fastener 24 projects through bore 42 and has been tightened onto conductor 60 with a sufficient force to deflect arm 54 upward away from base portion 52 by a distance Y. In one embodiment, fastener 24 is a hex-head fastener capable of exerting a torque of between about 10 lb-in and about 25 lb-in against conductor 60.

While not bound to any particular theory of operation, it is believed that the energy employed in securing fastener 24 against conductor 60 is stored in arm 54, which is deflected by the distance Y in a manner that provides a spring force (and thereby stores spring energy) to arm 54 that is transferred through fastener 24 into conductor 60. Heating and cooling cycles of connector 20 can be expected to thermally expand and contract body 22. Arm 54, however, provides a spring force that compliantly secures fastener 24 against conductor 60 during the heating and cooling cycles and maintains an electrical connection between conductor 60 and body 22.

Figure 3:
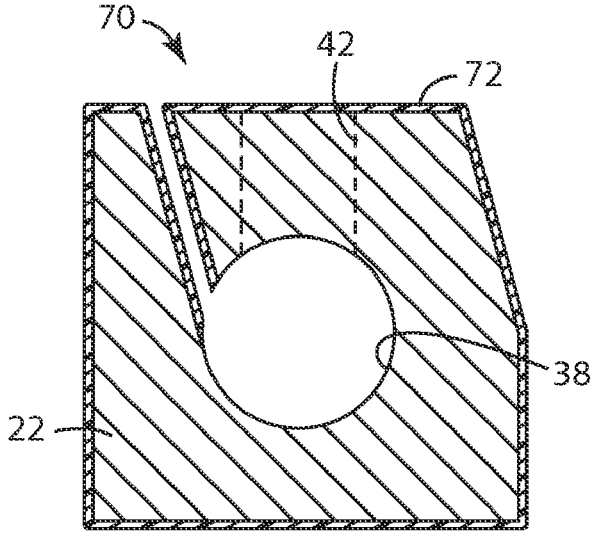
FIG. 3 is a cross sectional view of an electrical connector according to another embodiment of the invention.

FIG. 3 provides a cross sectional view of electrical connector 70 according to another embodiment of the invention. Electrical connector 70 includes body 22 and insulator 72 disposed on an exposed exterior surfaces of body 22. Body 22 is as described above and includes opening 38 sized to receive a conductor and bore 42 configured to receive fastener 24. Insulator 72 may be applied over all exterior surfaces of body 22 to provide electrical insulation to body 22. Preferably, insulator 72 is not fully coated in openings 38 or 42 such that body 22 can electrically communicate with a conductor inserted into opening 38.

Suitable materials for insulator 72 include materials having low electrical conductivity (i.e., insulators) such as plastics, plastics with fillers, thermoplastics, thermoformable (cured)

plastics, moldable rubbers, and the like. In one embodiment, insulator 72 includes a plastisol formed of a dispersion of a vinyl polymer in a suitable solvent. Insulator 72 is preferably configured to cure to a solid at room temperature and provide a chemically-resistant insulating coating over the exterior surfaces of body 22. Suitable plastisols are available from Lakeside Plastics, Inc., Oshkosh, Wis.

Figure 4:
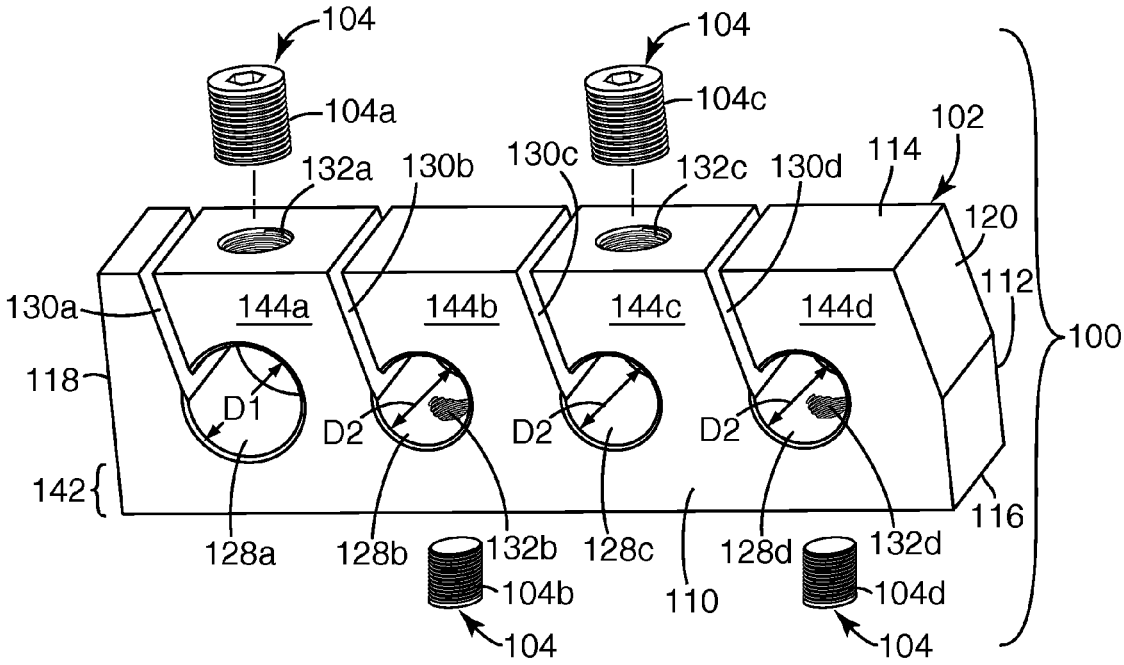
FIG. 4 is a perspective view of an electrical connector provided with a plurality of conductor openings according to one embodiment of the invention.

FIG. 4 provides a perspective view of an electrical connector 100 according to another embodiment of the invention. Here electrical connector 100 includes bus bar 102 and fasteners 104 configured to secure conductors that may be spliced through bus bar 102.

Bus bar 102 includes opposing major faces 110, 112 extending between opposing first and second side surfaces 114, 116 and opposing ends 118, 120. In one embodiment, bus bar 102 defines multiple openings 128*a*, 128*b*, 128*c*, 128*d* (collectively "openings 128") extending between major faces 110, 112, where each opening 128*a-d* includes a slot 130*a*, 130*b*, 130*c*, 130*d*, respectively, extending from the opening 128*a-d* to side 114.

Openings 128 are sized to receive conductors. The diameter of the openings 128 need not be the same, although openings having equal diameters are possible depending upon the desired end application. Four openings 128 are shown, although it is within the scope of this disclosure to provide for any number of suitable openings 128, ranging from 1 to 8 or more. In one embodiment, opening 128*a* has a diameter D1 and openings 128*b*-128*c*-128*d* each has a diameter of D2 that is smaller than the diameter D1. Nonlimiting representative sizes for diameter D1 can range from about 0.6 to about 1.25 inches to accommodate the diameter of an incoming feeder line, for example, although other sizes for diameter D1 are also considered acceptable. Nonlimiting representative sizes for diameter D2 can range from about 0.25 to about 0.6 inches to accommodate the diameter of outgoing service lines, for example, although other sizes for diameter D2 are also considered useful.

In one embodiment, bus bar 102 includes a repeated structural pattern of, for example, opening 128*a*, slot 130*a* communicating with opening 128*a*, and arm 144*a* extending from base portion 142 and defined at least in part by opening 128*a*, slot 130*a*, and side 114. In the embodiment illustrated in FIG. 4, bus bar 102 includes four arms 144*a*, 144*b*, 144*c*, 144*d* (collectively "arms 144") each defined in part by one opening 128, one slot 130, and side 114. Although bus bar 102 includes four openings 128*a-d* and four arms 144*a-d*, it will be understood that bus bar 102 can include as few as one opening and one arm, or as many as a half-dozen or more openings 128 and arms 144.

Arms 144 are configured to deflect or displace in response to one of the fasteners 104 secured against a conductor inserted into an opening 128. In one embodiment, arm 144*a* includes a bore 132*a* configured to receive fastener 104*a*, arm 144*c* includes a bore 132*c* configured to receive fastener 104*c*, and side surface 116 defines bores 132*b*, 132*d* configured to receive fasteners 104*b* and 104*d*, respectively. In such embodiments, when a conductor is inserted into an opening 128 and a fastener 104 is secured within a bore 132, an affected arm 144 deflects away from the conductor as the fastener 104 fastens against it. To this end, arms 144 provide a spring force that compliantly secures fasteners 104 against the conductors as bus bar 102 thermally expands or contracts during heating and cooling cycles.

Suitable materials for fabricating bus bar 102 and fasteners 104 include those conductive materials described above for electrical connector 20. In one embodiment, bus bar 102 may be fabricated of aluminum and configured to provide suitable electrical conductivity for a branch splice connector. In another embodiment, bus bar 102 may be fabricated of bronze and suited for use as a grounding junction block useful, for example, on cellular towers and/or underground junctions.

Figure 5:
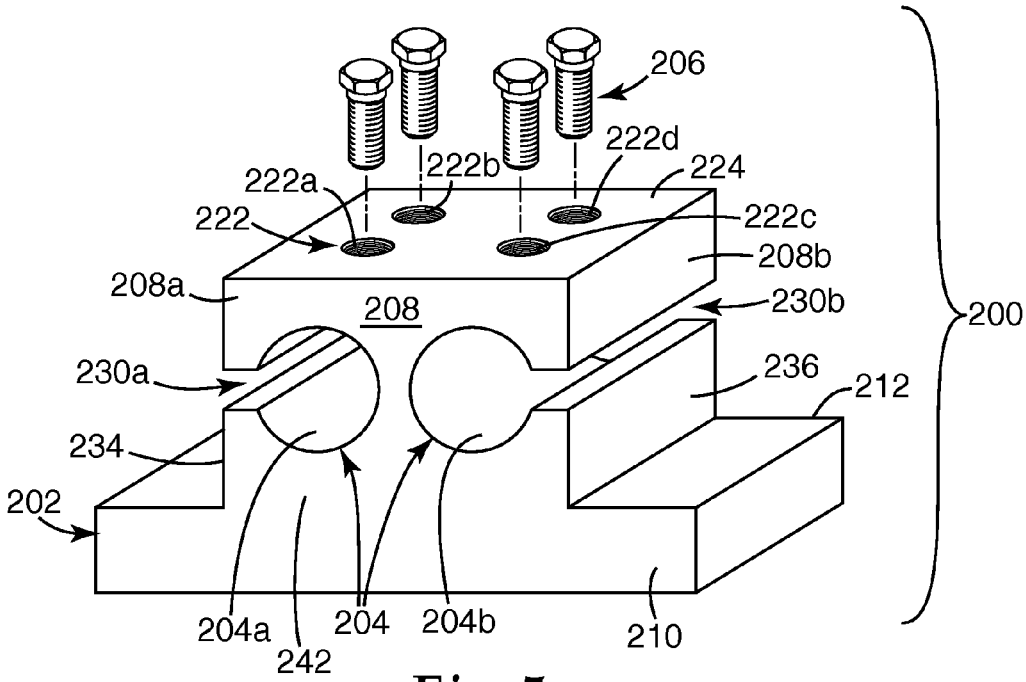
FIG. 5 is a perspective view of an electrical splice connector according to another embodiment.

FIG. 5 provides a perspective view of electrical connector 200 according to still another embodiment of the invention. Electrical connector 200 provides a two-hole splice connector that includes body 202 defining openings 204 configured to receive conductors, fasteners 206 configured to be fastened against the conductors, and arms 208 configured to deflect when fasteners 206 are tightened against the conductors in a manner that provides a spring force that compliantly secures fasteners 206 against the conductors.

In one embodiment, body 202 is fabricated from an electrically conducting metal such as aluminum and includes openings 204*a*, 204*b* extending between opposing major faces 210, 212 of body 202. Fasteners 206 are configured to be selectively tightened against conductors inserted into openings 204*a*, 204*b*. Fasteners 206 may be in the form of fasteners similar to the threaded set screws of fasteners 24 described above or may include the illustrated bolts. Other suitable fasteners may also be employed.

Bores 222 are formed in side 224 of body 202 and communicate with openings 204. Each opening 204 is associated with two bores 222 sized to receive two fasteners 206 selected to ensure a suitably large torque force delivered by fasteners 206 against an inserted conductor. In an exemplary embodiment, two bores 222*a*, 222*b* are formed in side 224 and communicate with opening 204*a*, and two bores 222*c*, 222*d* are formed in side 224 and communicate with opening 204*b*. Dual fasteners 206 for each opening 204 ensures that arms 208 will adequately deflect and provide a compliant spring force to secure fasteners 206 against the conductor during the heating and cooling cycles.

In one embodiment, a first arm 208*a* is defined in part by opening 204*a* and a slot 230*a* formed in side 234 of body 202 to communicate with opening 204*a*. A second arm 208*b* is defined in part by opening 204*b* and a slot 230*b* formed between side 236 of body 202 and opening 204*b*. Slots 230*a* and 230*b* decouple a portion of each arm 208*a*, 208*b* from body 202 to enable arms 208 to move during heating and cooling cycles. For example, arms 208 are cantilevered relative to base portion 242 of body 202 and are configured to flex toward (i.e., "contract") and away (i.e., "expand") from base portion 242 to provide compliant cantilevered arms 208 that accommodate heating and cooling cycles of connector 200.

Depending on a particular chosen end-use environment, electrical connector 200 may include an uninsulated electrically conductive body 202 suited for electrically splicing one or more conductors. In other embodiments more appropriate for other end-uses, electrical connector 200 includes an insulated body 202 covered with an electrical insulator (similar to body 22 of FIG. 3) where at least a portion of the surface of openings 204 is exposed for electrical conduction. One suitable insulative coating for body 202 may include a vinyl-based plastisol, although other suitable insulators such as moldable rubbers are also considered useful and appropriate.

Figure 6:
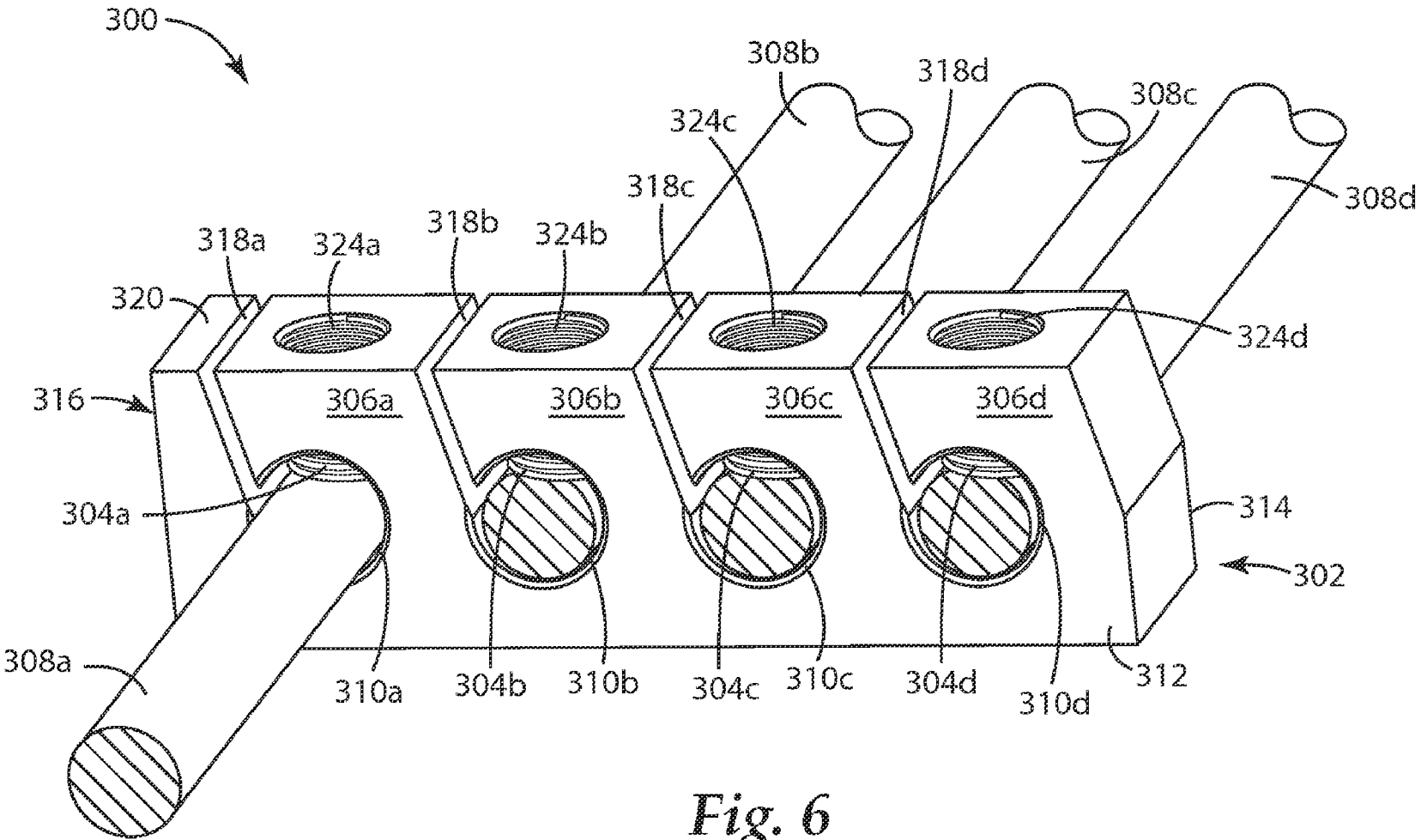
FIG. 6 is a perspective view of a connector assembly according to one embodiment of the invention.

FIG. 6 provides a perspective view of a connector assembly 300 according to an embodiment of the invention. Connector assembly 300 generally includes a connector 302 having a fastener 304 inserted through each of four arms 306. Fasteners 304 compliantly maintain a plurality of conductors 308 in electrical connection with connector 302. In an electrical splice application branching service lines to a neighborhood, for example, conductors 308 can include aluminum core conductors and connector 302 may be fabricated of aluminum.

In one embodiment, connector 302 defines openings 310*a*, 310*b*, 310*c*, 310*d* extending between opposing major faces 312, 314 of body 316. Slots 318*a*, 318*b*, 318*c*, 318*d* extend between a respective one of the openings 310 and a first side 320 of body 316. Each arm 306*a*, 306*b*, 306*c*, 306*d* is defined in part between a respective opening 310 and a respective slot 318. Each arm 306 defines a bore 324*a*, 324*b*, 324*c*, 324*d*, respectively, in communication with an opening 310*a*, 310*b*, 310*c*, 310*d*.

A suitable fastener such as a threaded hex-head fastener may be threaded into one of the bores 324*a-d* and compressed against a respective one of the conductors 308*a*-308*d*. The force of the fastener 304 compressed against conductor 308 compliantly deflects arm 306 away from conductor 308. Arms 306 provide a spring force that urges fasteners 304 against their respective conductors 308 such that electrical connectivity is maintained during heating and cooling (i.e., expansion and contraction) of connector 302.

In one embodiment, connector assembly 300 forms a feeder line splice assembly, where conductor 308*a* represents an incoming feeder line that is electrically spliced to three outgoing service line conductors 308*b*, 308*c*, and 308*d*. In an exemplary embodiment, feeder line conductor 308*a* is an aluminum conductor sized to provide about 1000 kcmils service, and the three service conductors 308*b-d* are sized to provide about 250 kcmils service branched to an individual house or business. Connector 302 may be formed of aluminum to provide a low cost aluminum block distribution bus compatible with the aluminum feeder line and service lines. Other materials are also, however, considered acceptable and their particular selection will largely depend on end-user's specifications.

Various embodiments of the invention provide an electrical splice connectors having at least one compliant arm configured to maintain an electrical connection with a conductor during heating and cooling cycles. Other embodiments of the invention provide bus bar electrical connectors that include a plurality of openings and a plurality of compliant arms each disposed between adjacent openings. Such connectors are configured to provide a junction or splice between an incoming feeder line and one or more outgoing service lines that branch across a grid to deliver electricity to a neighborhood of homes or several businesses.

Although specific embodiments have been illustrated and described herein, it will be appreciated by those of ordinary skill in the art that a variety of alternate and/or equivalent implementations may be substituted for the specific embodiments illustrated and described without departing from the scope of the invention. This application is intended to cover any adaptations or variations of electrical connectors, bus bars, and connector assemblies as discussed herein. Therefore, it is intended that this invention be limited only by the claims and the equivalents thereof.

What is claimed is:

1. An electrical connector configured to maintain an electrical connection with a conductor during heating and cooling cycles, the electrical connector comprising:

a base portion;

a cantilevered arm extending from the base portion, the arm and the base portion combining to define an opening configured to receive the conductor, and one of the arm and the base portion defining a bore communicating with the opening; and a body defining a slot that decouples the cantilevered arm from the body;

wherein a fastener inserted into the bore is configured to retain the conductor inserted into the opening and the cantilevered arm is configured to deflect to provide a spring force that secures the fastener against the conductor during the heating/cooling cycles.

2. The electrical connector of claim 1, wherein the slot extends between a top side of the body and the opening.

3. The electrical connector of claim 1, wherein the bore comprises a threaded bore formed in the top side of the body, the threaded bore substantially perpendicular to the opening.

4. The electrical connector of claim 1, further comprising:

a body comprising a plurality of cantilevered arms each extending from the base portion, the body defining a plurality of openings each configured to receive a conductor and a slot extending between each opening and a surface of the body;

wherein each cantilevered arm is defined by one of the openings, one of the slots, and the surface of the body.

5. The electrical connector of claim 1, further comprising:

electrical insulation material disposed on exterior surfaces of the base portion and the arm.

6. A bus bar configured to maintain electrical connection with a conductor during cyclical heating/cooling, the bus bar comprising:

opposing major faces extending between opposing first and second side surfaces, the bus bar defining:

at least one opening extending between the opposing major faces and including a slot communicating with one of the first and second side surfaces, an arm comprising an exterior surface defined at least in part by the at least one opening, the slot, and the first side surface, at least one bore formed in one of the first and second side surfaces and communicating with the at least one opening;

wherein a fastener inserted into the at least one bore retains the conductor inserted into the at least one opening and the arm is configured to deflect to provide a spring force that secures the fastener against the conductor during heating and cooling cycles.

7. The bus bar of claim 6, wherein the bus bar defines a plurality of openings, each opening extending between the opposing major faces and including a slot communicating with the first side surface.

8. The bus bar of claim 7, wherein the plurality of openings comprises a feeder opening having a first diameter and at least two service openings each having a diameter that is less than the first diameter.

9. The bus bar of claim 7, comprising a plurality of arms, each arm disposed between an adjacent one of the plurality of openings.

10. The bus bar of claim 9, wherein at least one of the plurality of arms defines a bore extending from the first side surface to a respective one of the openings.

11. The bus bar of claim 9, wherein the bus bar defines at least one bore extending from the second side surface to a respective one of the openings.

12. The bus bar of claim 6, wherein the at least one bore is formed substantially normal to the at least one opening.

13. The bus bar of claim 11, wherein the at least one bore comprises a threaded bore and the fastener comprises a threaded screw.

* * * * *